US006409207B1

(12) United States Patent
Kuo

(10) Patent No.: US 6,409,207 B1
(45) Date of Patent: Jun. 25, 2002

(54) SWIVEL DRAW BAR STRUCTURE OF A SUITCASE

(75) Inventor: Chung-Hsien Kuo, Taipei Hsien (TW)

(73) Assignee: Chaw Khong Technology Co., Ltd., Taipei Hsien (TW)

( * ) Notice: Subject to any disclaimer, the term of this patent is extended or adjusted under 35 U.S.C. 154(b) by 75 days.

(21) Appl. No.: 09/686,857

(22) Filed: Oct. 12, 2000

(30) Foreign Application Priority Data

Jul. 17, 2000 (TW) ..... 089212335

(51) Int. Cl.[7] ..... B62B 1/00; A45C 13/00; A47B 95/02

(52) U.S. Cl. ..... 280/665.1; 190/115; 16/115

(58) Field of Search ..... 280/655, 655.1, 280/47.26, 47.315, 47.371; 190/18 A, 115; 16/113.1, 324, 326, 900; 403/92, 93, 97, 101, 325

(56) References Cited

U.S. PATENT DOCUMENTS 5,765,857 A * 6/1998 Hsiao ..... 280/646
5,864,921 A * 2/1999 Chou ..... 16/115
5,884,362 A * 3/1999 Tsai ..... 16/115
5,901,822 A * 5/1999 Tu ..... 190/115
6,216,317 B1 * 4/2001 Chen ..... 16/430
6,332,241 B1 * 12/2001 Kuo ..... 16/113.1

* cited by examiner

*Primary Examiner*—Brian L. Johnson
*Assistant Examiner*—G. Klebe
(74) *Attorney, Agent, or Firm*—Rosenberg, Klein & Lee

(57) ABSTRACT

A swivel draw bar structure of a suitcase. A fixing sleeve is installed at the top end of the lower joint tube of the draw bar. A projective arc plate is joined at the center of the top surface of the fixing sleeve. A plurality of teeth are formed on the top surface of the arc plate. A downward straight groove is formed on the top surface of the fixing sleeve. A slide sheet is inserted in the straight groove. The bottom end of the slide sheet is a bevel joined with a bevel of a retractable button so that the retractable button can slide in a transversal groove of the fixing sleeve. The projective part of the retractable button can penetrate through the transversal groove and protrude out of a hole of the fixing sleeve to be locked in a hole of the lower joint tube. A swivel sleeve seat is joined at the bottom end of the upper joint tube. A pair of auriform sheets having holes extend downwards from the swivel sleeve seat. The holes of the auriform sheets are joined a central hole of the arc plate via a spindle. An upward longitudinal groove is formed on the bottom surface of the swivel sleeve seat for insertion of a slide retaining element. The slide retaining element is connected to the swivel sleeve seat through pin connection. The top end of the slide retaining element is joined with a drive element to drive the slide retaining element to move upwards or downwards. A tooth part is formed on the bottom surface of the slide retaining element to mesh with the teeth of the arc plate. A retaining sheet extends from the bottom surface of the slide retaining element. The bottom end of the retaining sheet contacts with the top end of the slide sheet to push the retractable button to be positioned in the lower joint tube.

9 Claims, 7 Drawing Sheets

SWIVEL DRAW BAR STRUCTURE OF A SUITCASE

FIELD OF THE INVENTION

The present invention relates to a swivel draw bar structure of a suitcase and, more particularly, to a fixing structure which can achieve positioning and locking effects after turned.

BACKGROUND OF THE INVENTION

Along with continual prevalence of travel mood and growing frequency of international business, demand of using traveling suitcases becomes higher and higher. When walking and pulling a suitcase, the best usage is to pull it along an elevation angle of 45 degrees. However, because the height of each person differs, the structure of the suitcase needs to be designed to meet different requirements. A suitcase having a retractable draw bar is the best trap taken along with a traveler. Two-joint type or multiple-joint type draw bars have been widely used in the structure of suitcases, wherein the two-joint type draw bars are more generally used. When the upper joint tube of a two-joint type draw bar is pulled out, only the bottom end of the upper joint tube and the top end of the lower joint tube are positioned. Because the length of each pulled-out joint tube can not properly be matched to each user, and because much difference will exist in the arrangement of the draw bar according to the height of the suitcase, the best angle of usage can not be achieved for every user. FIGS. 8 and 9 show a prior art structure of a draw bar, wherein a swivel upper joint tube 14 is installed at the top end of a lower joint tube 11. The upper joint tube 14 is pivotally joined between a pair of auriform sheets 111 of the lower joint tube 11 via a projective middle sheet 141. A plurality of holes 142 are disposed on the bottom plane of the middle sheet 141 for receiving a fixing bead 113, which is disposed in a groove hole 112 at the top end of the lower joint tube 11 and stuck by a spring 114. The structure is like an axial fixing structure of an electric fan. The advantage is that the adjustment and positioning of the fixing bead is very easy. However, this structure has the disadvantage that the position of the fixing bead will easily move because of the pressing force on the fixing bead. Therefore, the fixing effect is not good.

SUMMARY AND OBJECTS OF THE PRESENT INVENTION

The primary object of the present invention is to provide a swivel draw bar structure of a suitcase so that the draw bar can be properly turned to be applicable to different situations of usage. The present invention can be applied to two-wheeled or four-wheeled suitcases. The user can set the most suitable angle of usage when pulling the suitcase. Moreover, the draw bar can be exactly positioned at the selected position. The adjustment of position can be proceeded via the handle according to the protraction/retraction action of the draw bar. Additionally, other joint tubes can be received in the lowermost joint tube.

To achieve the above object, a fixing sleeve is installed at the top end of the lower joint tube of the draw bar. A projective arc plate is joined at the center of the top surface of the fixing sleeve. A plurality of teeth are formed on the top surface of the arc plate. A downward straight groove is formed on the top surface of the fixing sleeve. A slide sheet is inserted in the straight groove. The bottom end of the slide sheet is a bevel joined with a bevel of a retractable button so that the retractable button can slide in a transversal groove of the fixing sleeve. The projective part of the retractable button can penetrate through the transversal groove and protrude out of a hole of the fixing sleeve to be locked in a hole of the lower joint tube. A swivel sleeve seat is joined at the bottom end of the upper joint tube. A pair of auriform sheets having holes extend downwards from the swivel sleeve seat. The holes of the auriform sheets are joined with a central hole of the arc plate via a spindle. An upward longitudinal groove is formed on the bottom surface of the sleeve seat for insertion of a slide retaining element. The slide retaining element is connected to the swivel sleeve seat through pin connection. The top end of the slide retaining element is joined with a drive element to drive the slide retaining element to move upwards or downwards. A tooth part is formed on the bottom surface of the slide retaining element to mesh with the teeth of the arc plate. A retaining sheet extends from the bottom surface of the slide retaining element. The bottom end of the retaining sheet contacts with the top end of the slide sheet to push the retractable button to be positioned in the lower joint tube.

The various objects and advantages of the present invention will be more readily understood from the following detailed description when read in conjunction with the appended drawings, in which:

DETAILED DESCRIPTION OF PREFERRED EMBODIMENT

Figure 1:
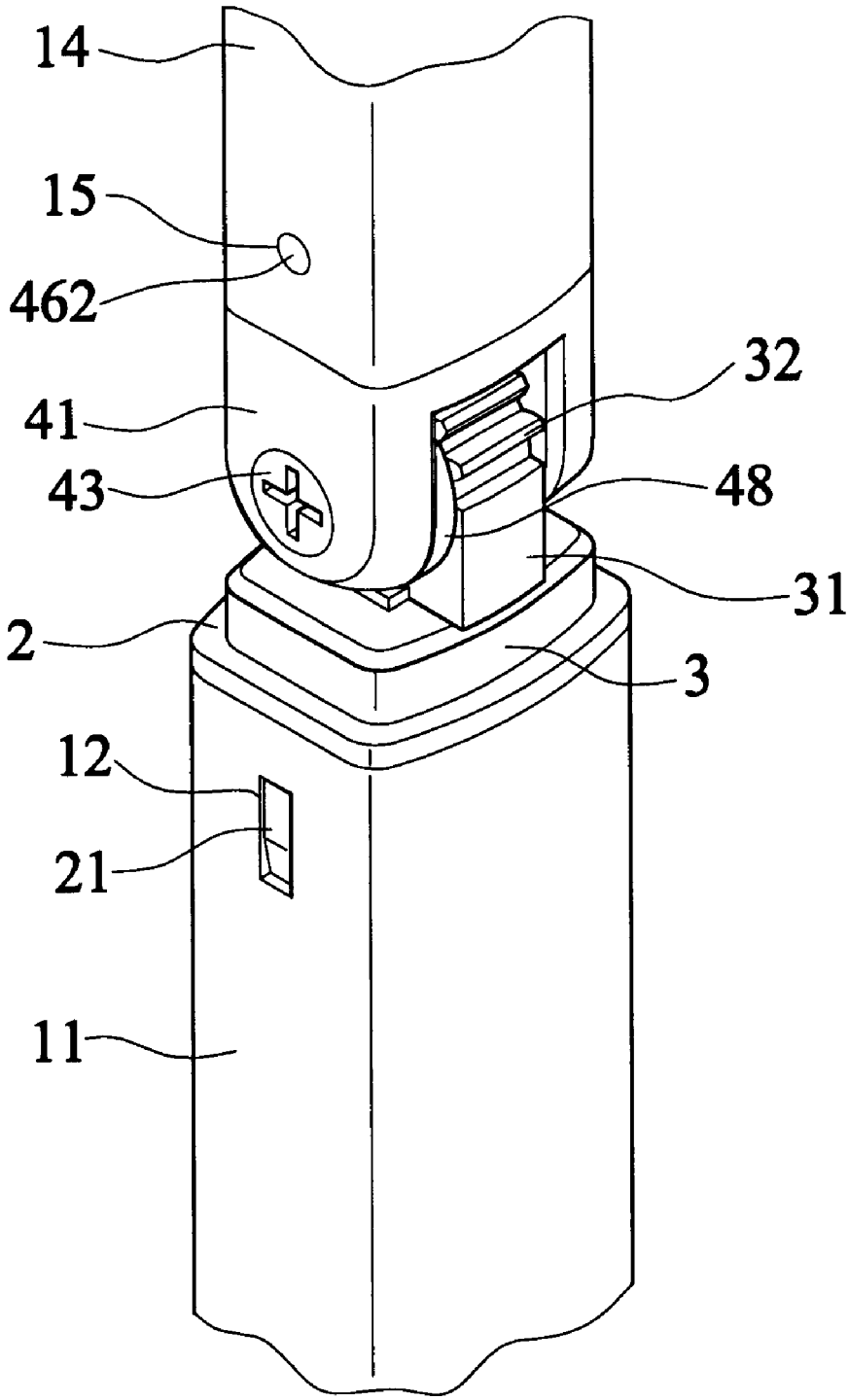
FIG. 1 is a perspective view of the present invention.
Figure 2:
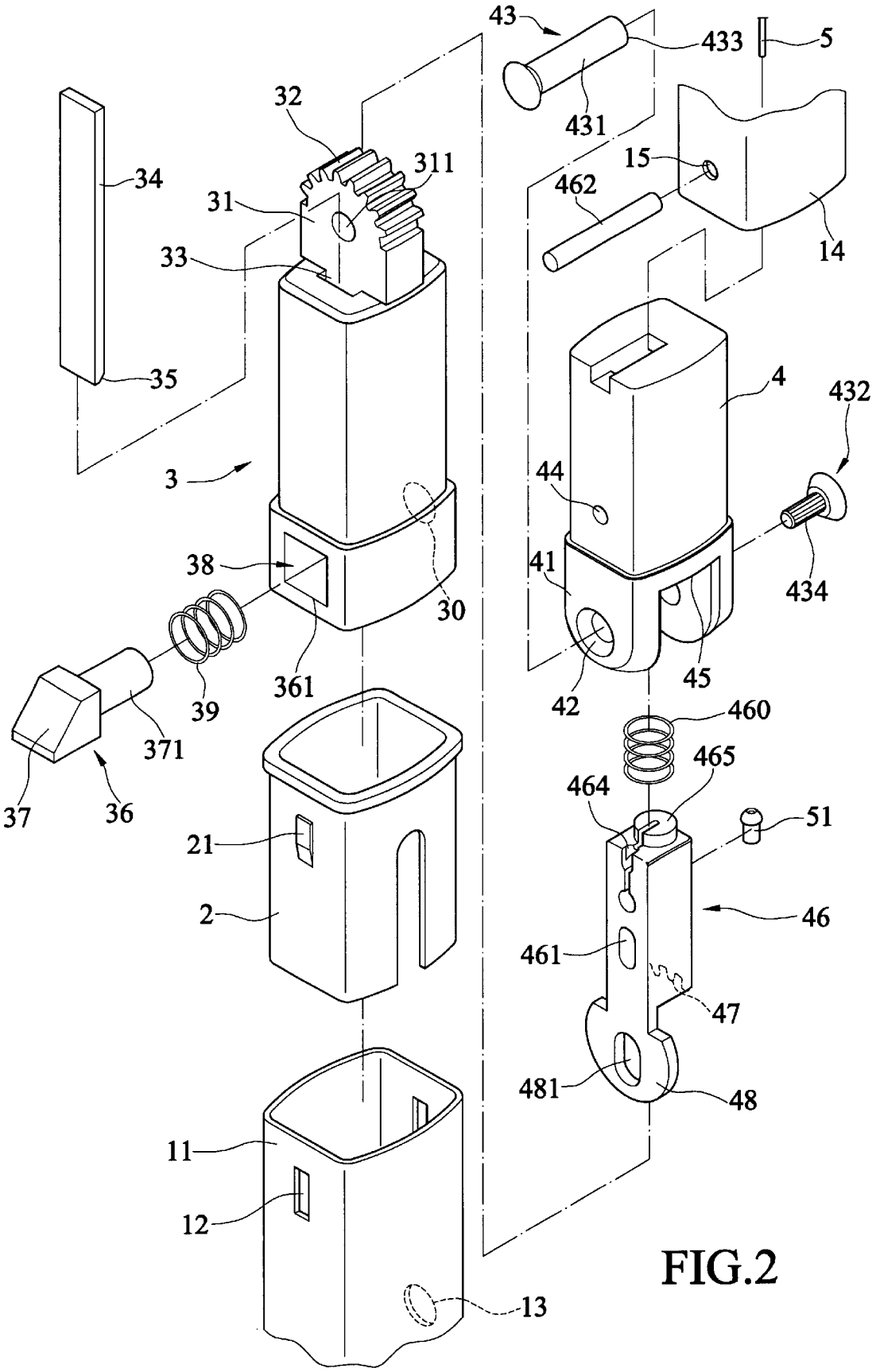
FIG. 2 is an exploded perspective view of the present invention.

FIGS. 1 to 7 show a swivel draw bar structure of a suitcase according to the present invention, wherein FIGS. 1 to 4 illustrate the present invention mainly with a two-joint type draw bar. A draw bar 1 comprises a lower joint tube 11 and an upper joint tube 14. A fixing sleeve 3 is installed at the top end of the lower joint tube 11 of the draw bar 1. A projective arc plate 31 is joined at the center of the top surface of the fixing sleeve 3. A plurality of teeth 32 are formed on the top surface of the arc plate 3. A downward straight groove 33 is formed on the top surface of the fixing sleeve 3. A slide sheet 34 is inserted in the straight groove 33. The bottom end of the slide sheet 34 is a bevel 35 joined with a bevel 37 of a retractable button 36 so that the retractable button 36 can slide in a transversal groove 38 of the fixing sleeve 3. The retractable button 36 has a square main body penetrating through a square hole 361 of the transversal groove 38. The inner end of retractable button 36 is a cylindrical projective part 371. The projective part 371 can penetrate through the transversal groove 38 and protrude out of a hole 30 of the fixing sleeve 3 so that the projective part 371 can be locked in a hole 13 of the lower joint tube 11. A spring 39 is telescoped on the projective part 371 of the retractable button 36. One end of the spring 39 sticks to the inner end surface of the transversal groove 38.

A swivel sleeve seat 4 is joined at the bottom end of the upper joint tube 14 of the draw bar 1. A pair of auriform sheets 41, each having a hole 42, extend downwards from the swivel sleeve seat 4. The holes 42 of the auriform sheets 41 are joined with a central hole 311 of the arc plate 31 via a spindle 43. As shown in the figures, the spindle 43 comprises a female pin sleeve 431 and a mail pin 432 fixedly telescoped together. That is, a fixing hole seat 433 is formed on the axial end surface of the female pin sleeve 431. Pressed vein 434 is formed on the peripheral region of the male pin 432. The male pin 432 is shorter and thinner than the female pin sleeve 431. The male pin 423 is inserted and fixed in the fixing hole seat 433 of the female pin sleeve 431 via the peripheral region having pressed vein 434. The spindle 43 penetrates through the holes 42 of the auriform sheets 41 of the swivel sleeve seat 4 and the central hole 311 of the arc plate 31 so that the upper joint tube 14 can drive the swivel sleeve seat 4 to turn with the spindle 43 as the axis.

An upward longitudinal groove 45 is formed on the bottom surface of the swivel sleeve seat 4 for insertion of a slide retaining element 46 having a long hole 461. The long hole 461 is joined with a pin hole 44 of the swivel sleeve seat 4 and a hole 15 of the upper joint tube 14 via a pin 462. The top end of the slide retaining element 46 is joined with a drive element 5. The drive element 5 can be a steel wire as shown in FIGS. 1 to 4, or can be a guide bar 50 inserted in an insertion hole 464 as shown in FIG. 5. The function of the drive element 5 is to drive the slide retaining element 46 to move upwards. A fixing head 51 at the bottom end of the steel wire 5 is jammed in a groove hole seat 463 of the slide retaining element 46. The source of drive force is an actuating element at the handle. The actuating element is a push button. When the push button is pressed, an upward action is generated so that the slide retaining element 46 is pulled upwards by the drive element 5. A tooth part 47 is formed on the bottom surface of the slide retaining element 46 to mesh with the teeth 32 of the arc plate 31. When the slide retaining element 46 is pulled upwards, the tooth part 47 and the teeth 32 of the arc plate 31 will no longer mesh together. Therefore, the upper joint tube 14 will no longer be locked and can be turned within set range of angle. A spring 460 is joined between a projective part 465 at the top end surface of the slide retaining element 46 and the inner end surface 451 of the longitudinal groove 45 of the swivel sleeve seat 4.

A retaining sheet 48 extends downwards from one side of the bottom surface of the slide retaining element 46. The height of the retaining sheet 48 is equal to or slightly larger than that of the auriform sheets 41 so that the retaining sheet 48 can contact with the top end of the slide sheet 34. An elliptic hole 481 penetrated through by the spindle 43 is formed on the retaining sheet 48 so that the retaining sheet 48 can match to the slide retaining element 46 to move upwards or downwards. When used, the drive element 5 is actuated to pull the slide retaining element 46 so that the upper joint tube 14 can drive the swivel sleeve seat 4 to turn. The retaining sheet 48 will also be turned along with the upper joint tube 14. When the drive element 5 is released, the tooth part 47 on the bottom surface of the slide retaining element 46 will mesh with the teeth 32 of the arc plate 31 again. Meanwhile, the slide retaining element 46 will restore to its original position because of the resilient force of the spring 460 to let the retaining sheet 48 contact with the top end of the slide sheet 34 and let the slide sheet 34 move downwards. The bevel 35 of the slide sheet 34 will push the bevel 37 of the retractable button 36 to let the retractable button 36 move to compress the spring 39. The projective part 361 of the retractable button 36 will protrude out of the hole 30 of the fixing sleeve 3 and be locked in the hole 13 of the lower joint tube 11. Thereby, the bottom end of the upper joint tube 14 can be positioned at the top end of the lower joint tube 11.

The resilient force of the spring 39 is smaller than that of the spring 460. The angle of the bevel of the slide sheet 34 is smaller than that of the bevel of the retractable button 36. The function of the spring 39 is to relieve the locking of bend to restore the retractable button 36 to its original position. The structure of the retractable button 36 is designed to be pushed out compulsively and to bounce back automatically. Contrarily, as shown in FIG. 5, a spring is installed at the rear end of a slide button 19 to bounce back automatically and to be pushed out compulsively. Thereby, when the upper joint tube 14 is turned, the whole structure can achieve positioning effect via the retractable button 36.

Additionally, it is not necessary to directly telescope the fixing sleeve 3 on the top end of the lower joint tube 11. Instead, a positioning sleeve 2 is joined at the top end of the lower joint tube 11. A pair of projective guards 21 on the periphery of the fixing sleeve 2 are secured in the fixing holes 12 of the lower joint tube 11. The top edge of the positioning sleeve 2 contacts with the top end surface of the lower joint tube 11. When the fixing sleeve 3 moves upwards in the lower joint tube 11 to the positioning sleeve 2, it will be blocked by the positioning sleeve 2. Thereby, the swivel sleeve seat 4 of the upper joint tube 14 along with the fixing sleeve 3 can be received in the lower joint tube 11. When the draw bar needs to be turned, they are pulled out again.

Figure 5:
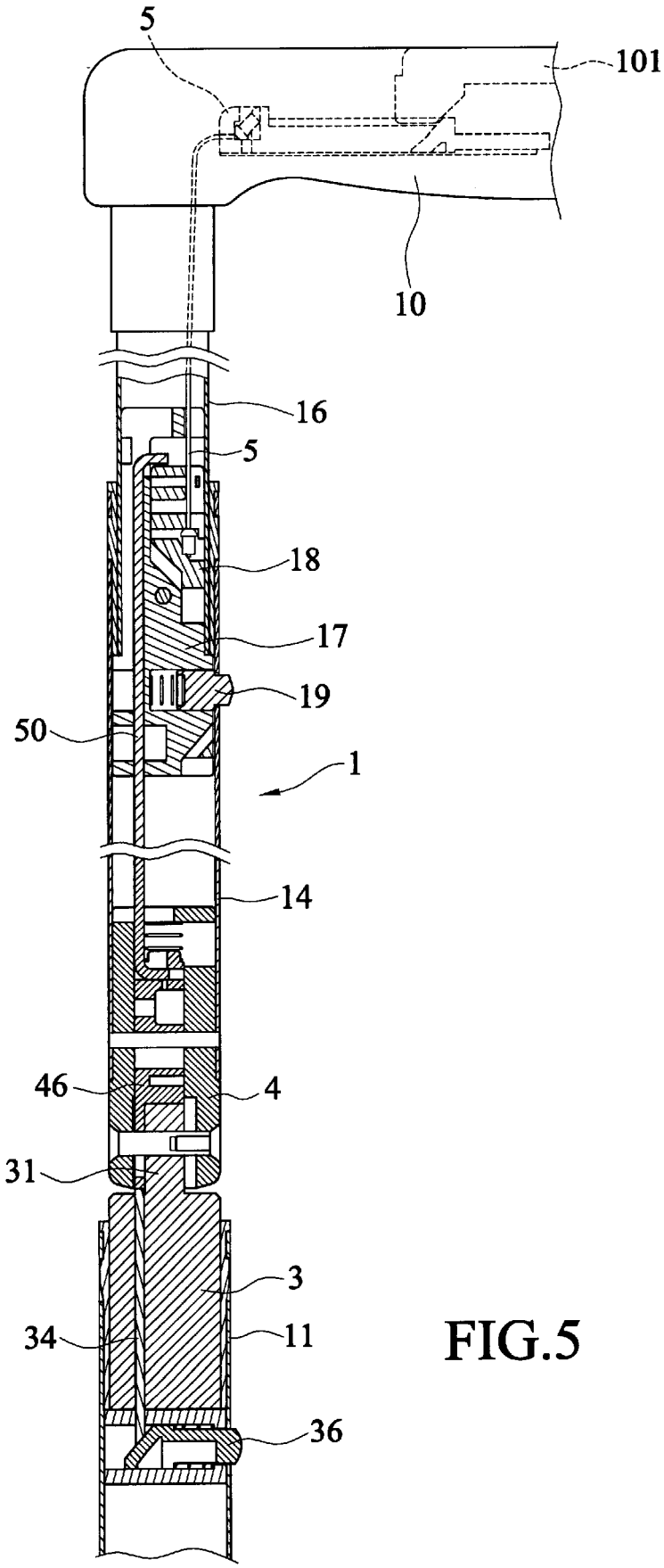
FIG. 5 is a cross-sectional view according to another embodiment of the present invention.
Figure 7:
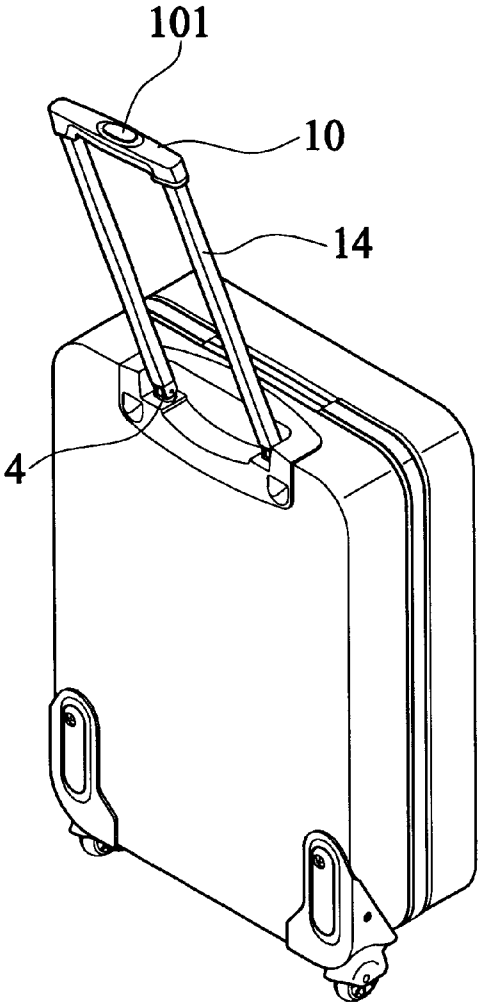
FIG. 7 is a perspective view of the present invention after the swivel draw bar structure is turned when used in a suitcase.
Figure 6:
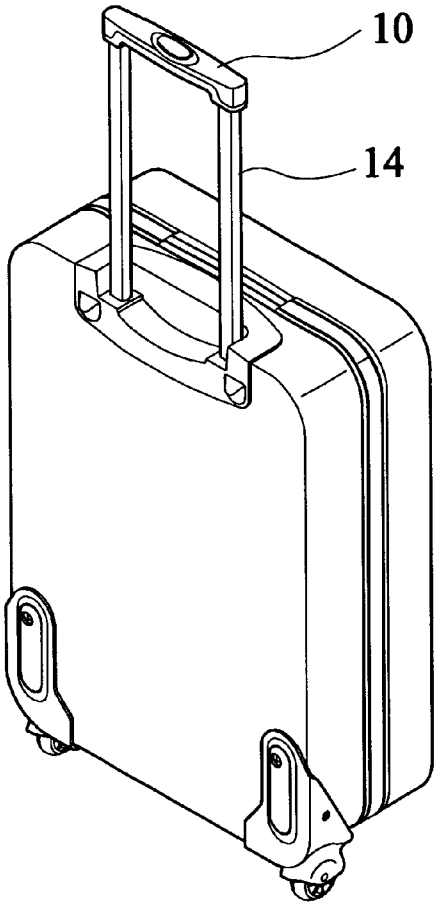
FIG. 6 is a perspective view of the present invention when used in a suitcase.
Figure 9:
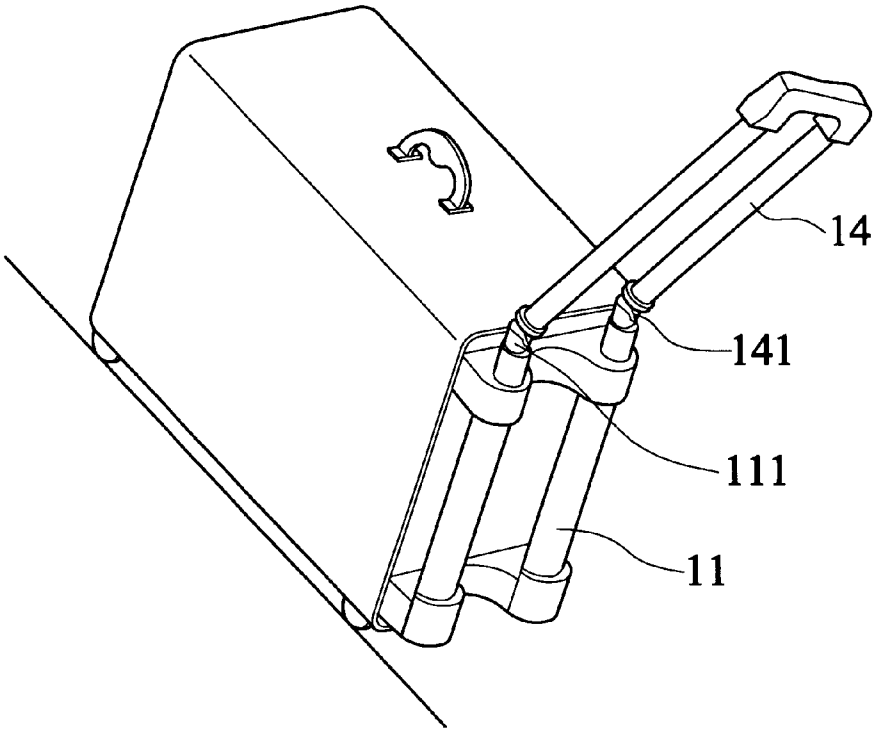
FIG.9 PRIOR ART
FIG. 9 is a perspective view of a prior art structure when used in a suitcase.
Figure 8:
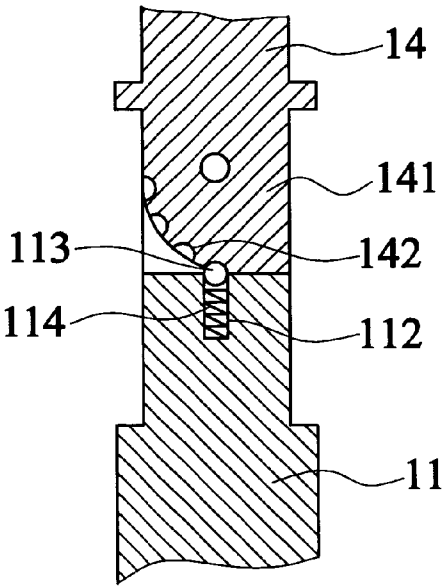
FIG.8 PRIOR ART
FIG. 8 is a partly cross-sectional view of a prior art structure.

To sum up, a swivel structure installed at the bottom end of the upper joint tube 14 is exploited in the present invention. The swivel structure can be telescoped in the lower joint tube 11 and move therein. When the upper joint tube 14 is entirely pulled out from the lower joint tube 11, the fixing sleeve 3 will move upwards along to the positioning sleeve 2. At this time, the retractable button 36 will be subjected to the push force of the slide retaining element 46 to the slide sheet 34 so that the projective part 371 of the retractable button 36 will be pushed out and positioned in the hole 13 of the lower joint tube 11. If a push button 101 on a handle 10 is pressed, the drive element 5 will drive the slide retaining element 46 to move upwards through the movement of a slide block, as shown in FIG. 5, so that the upper joint tube 14 can be turned, as shown in FIGS. 6 and 7. After turned, the button 101 of the handle 10 is released, the slide retaining element 46 will move downwards to be locked with the arc plate 31 and positioned there so that the upper joint tube 14 can no longer be turned. The slide retaining element 46 is locked with and positioned in the fixing sleeve 3. Only when the slide retaining element 46 is moved upwards to release the locking state can the upper joint tube 14 be turned to be positioned again. When the button 101 is pressed, the locking and positioning state of the retractable button 36 will be released at the same time. The spring 39 will restore the projective part 371 of the retractable button 36 to its original position. Therefore, the upper joint tube 14 not only can be turned, but also can retractably move downwards in the lower joint tube 11. When the push button 101 is released, the above retractable button 46 will automatically be pushed out and positioned.

Figure 3:
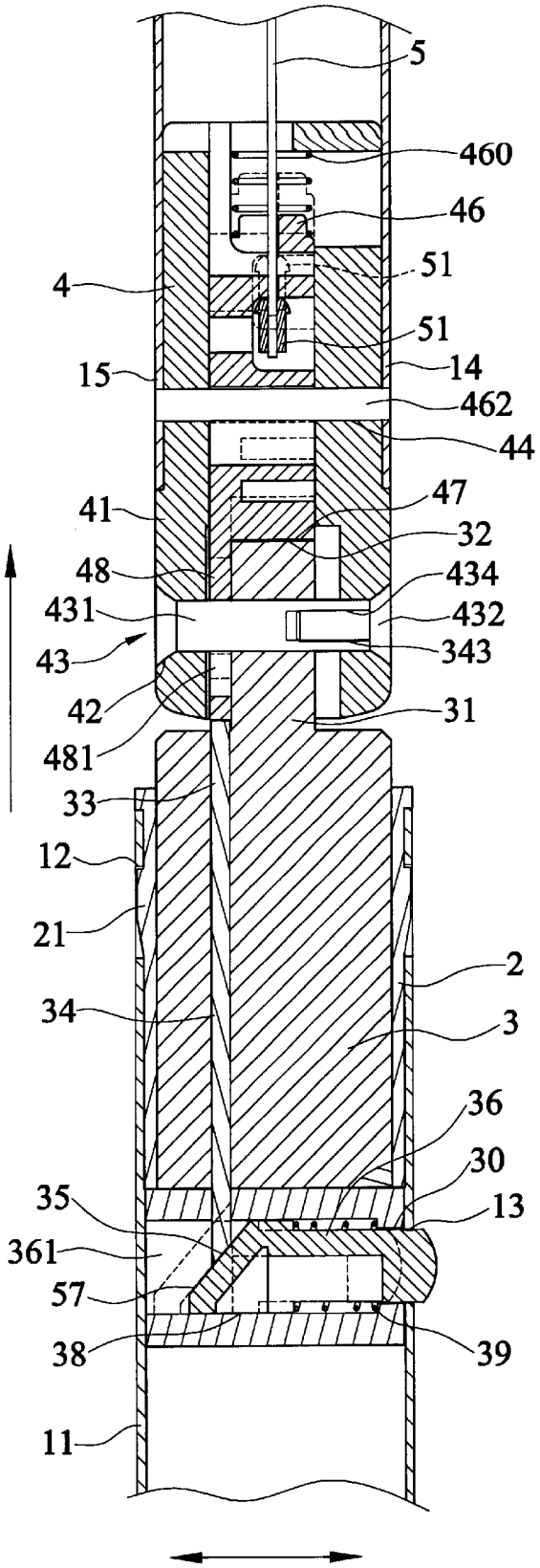
FIG. 3 is a cross-sectional view of the present invention.
Figure 4:
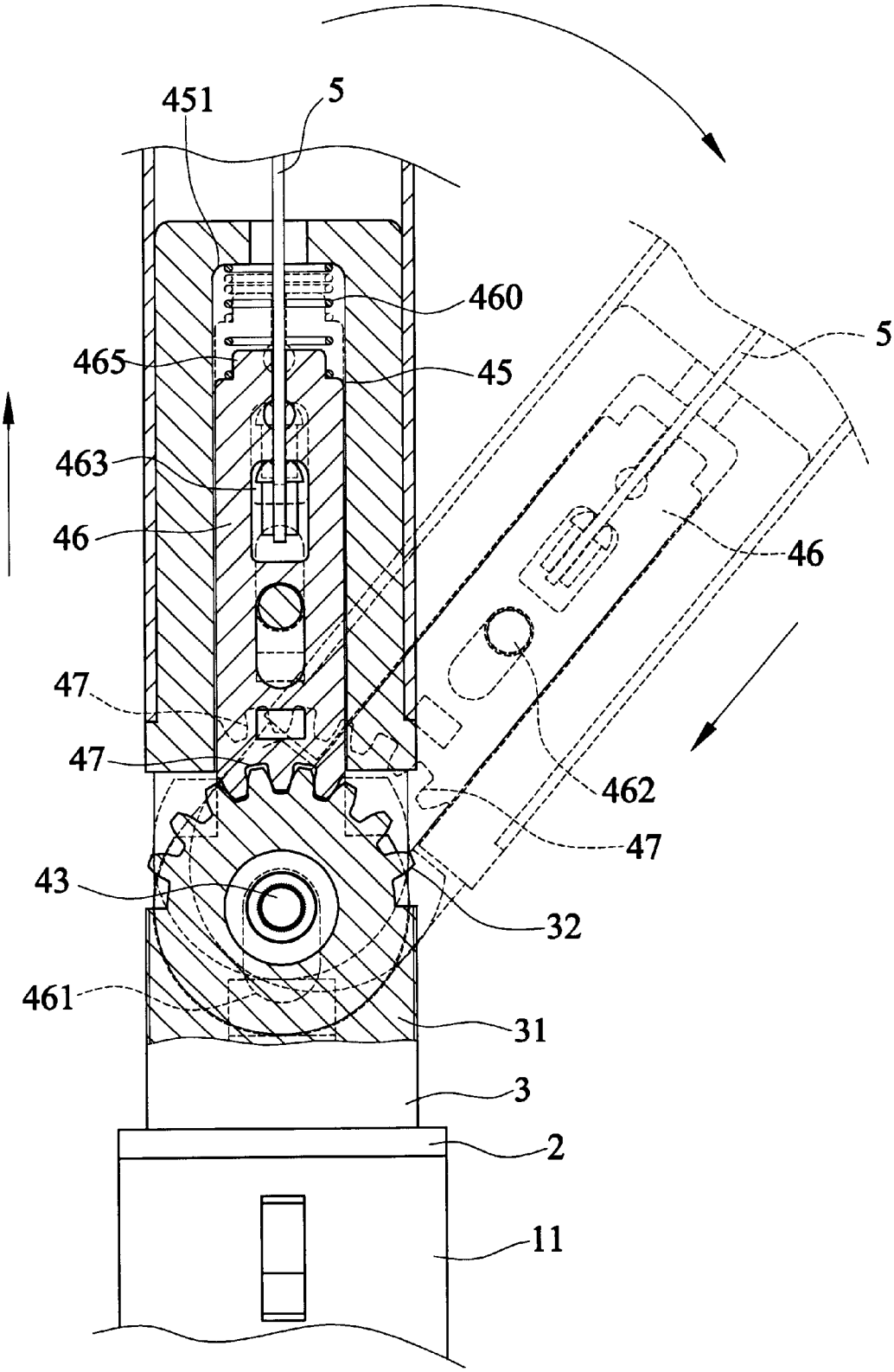
FIG. 4 is a cross-sectional view of the present invention after the swivel draw bar structure is turned.

At this time, the teeth 32 of the arc plate 31 of the fixing sleeve 3 will mesh more tightly with the tooth part 47 of the slide retaining element 46 in the swivel sleeve seat 4 so that the upper joint tube 14 can be maintained at this angle and can not be turned or moved, as shown in the adjustment states of FIGS. 3 and 4.

In the present invention, the slide sheet 34, the fixing sleeve 3, and the positioning sleeve 2 are fixed in the top end of the lower joint tube 11, and the swivel sleeve seat 4 and the slide retaining element 46 are fixed at the bottom end of the upper joint tube 14. The handle 10 is joined at the top end of the upper joint tube 14 for control and driving. The fixing sleeve 3 and the swivel sleeve seat 4 are joined to move together in the lower joint tube 11. Thereby, the present invention can provide positioning effect at the swivel structure. When the push button of the handle is released, the two joint tubes can achieve steadier positioning effect so that the draw bar not only can be pulled along the axial direction thereof, but also can be turned an angle for use. The draw bar of the present invention thus can be applied to two-wheeled suitcases or four-wheeled suitcases.

FIG. 5 is a diagram showing the situation that the present invention is applied to a three-joint type draw bar structure. A lower tube sleeve 17 is joined at the bottom end of an uppermost joint tube 16. An actuating sheet 18 is inserted in the lower tube sleeve 17. The bevels at two side of the actuating sheet 18 are exploited to drive the bevels at two sides of a slide button 19 to move so that the bottom end of the uppermost joint tube 16 and the top end of the upper joint tube 14 can be fixed. A drive element, being a guide bar 50, comprises an upper section of steel wire 5 and a lower section of steel bar, which are connected to the handle 10 and the slide retaining element 46, respectively. According to another embodiment of the present invention, a plurality of lapping parts, instead of the teeth, can be formed on the top surface of the arc plate 31. A lapped part is installed at the bottom surface of the slide retaining element 46 to be matched with the lapping parts of the arc plate 31.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A swivel draw bar structure of a suitcase, said draw bar comprising an upper joint tube and a lower joint tube, a handle being joined with said upper joint tube, a drive element being connected to said handle, said swivel draw bar structure comprising:

a fixing sleeve installed at the top end of said lower joint tube, an arc plate being installed at the center of the top surface of said fixing sleeve, a plurality of teeth being formed on the top surface of said arc plate, a transversal groove being disposed in said fixing sleeve, a hole being formed on one side surface of said transversal groove;

a swivel sleeve seat installed at the bottom end of said upper joint tube, a pair of auriform sheets having holes extending downwards from said swivel sleeve seat, said holes of said auriform sheets being joined with a central hole of said arc plate via a spindle, an upward longitudinal groove being disposed on the bottom surface of said sleeve seat; and a slide retaining element inserted in said longitudinal groove of said swivel sleeve seat, said slide retaining element having a long hole, said long hole being joined with a pin hole of said swivel sleeve seat and a hole of said upper joint tube via a pin so that said slide retaining element can be joined with said drive element, a tooth part being formed on the bottom surface of said slide retaining element to mesh with said teeth of said arc plate;

whereby when said drive element is pulled to let said tooth part of said slide retaining element no longer contact with said teeth of said arc plate, said swivel sleeve seat of said upper joint tube can be turned with respect to said fixing sleeve of said lower joint tube with said spindle as the axis.

2. The swivel draw bar structure as claimed in claim 1, wherein a downward straight groove is disposed on the top surface of said fixing sleeve and a transversal groove having a hole on one side surface thereof is disposed in said fixing sleeve, said swivel draw bar structure further comprising:

a slide sheet inserted in said straight groove of said fixing sleeve, a bevel being formed at the bottom end of said slide sheet;

a retractable button having a bevel on one side thereof, said bevel of said retractable button contacting with said bevel of said slide sheet so that said retractable button can slide in said transversal groove of said fixing sleeve, said retractable button having a projective part, said projective part being capable of protruding out of said hole of said fixing sleeve to be locked in a hole of said lower joint tube;

a retaining sheet extending downwards from said slide retaining element, said retaining sheet contacting with the top end of said slide sheet;

whereby as said upper joint tube is turned, said retaining sheet will drive said slide sheet to push said retractable button to be positioned in said hole of said lower joint tube, and when the drive element is released, said retractable button will retract back into said fixing sleeve.

3. The swivel draw bar structure as claimed in claim 2, wherein a spring is telescoped on said projective part of said retractable button.

4. The swivel draw bar structure as claimed in claim 1, wherein said spindle comprises a female pin sleeve and a male pin, a fixing hole seat being disposed on the axial end surface of said female pin sleeve, said male pin being shorter and thinner than said female pin sleeve, pressed vein being formed on the periphery of said male pin, said male pin being telescoped in said female pin sleeve.

5. The swivel draw bar structure as claimed in claim 1, wherein a spring is arranged between the top end of said slide retaining element and the inner end surface of said longitudinal groove of said swivel sleeve seat.

6. The swivel draw bar structure as claimed in claim 1, wherein a positioning sleeve is further installed at the top end of said lower joint tube, a pair of projective guards on the periphery of said positioning sleeve being secured in fixing holes of said lower joint tube, the top edge of said positioning sleeve contacting with the top end surface of said lower joint tube, said positioning sleeve being used to block said fixing sleeve.

7. The swivel retractable draw bar structure as claimed in claim 1, wherein said swivel sleeve seat is joined with said upper joint tube and said fixing sleeve can be received in said lower joint tube.

8. The swivel draw bar structure as claimed in claim 1, wherein said draw bar is a multiple-joint draw bar.

9. A swivel draw bar structure of a suitcase, said draw bar comprising an upper joint tube and a lower joint tube, a handle being joined with said upper joint tube, a drive element being connected to said handle, a swivel sleeve seat being installed at the bottom end of said upper joint tube, a fixing sleeve being installed at the top end of said lower joint tube, said swivel sleeve seat being pivotally joined with said fixing sleeve via a spindle, an upward longitudinal groove being disposed on the bottom surface of said swivel sleeve seat, said swivel draw bar structure further comprising:

a slide retaining element inserted in said longitudinal groove of said swivel sleeve seat, said slide retaining element having a long hole, said long hole being joined with a pin hole of said swivel sleeve seat and a hole of said upper joint tube via a pin, said slide retaining element being joined with said drive element, a retaining sheet extending downwards from said slide retaining element, an elliptic hole penetrated through by said spindle being formed on said retaining sheet, a straight groove and a transversal groove being disposed in said fixing sleeve;

a slide sheet inserted in said straight groove of said fixing sleeve, the top end of said slide sheet contacting with said retaining sheet of said slide retaining element; and a retractable button installed in said transversal groove of said fixing sleeve and contacting with the bottom end of said slide sheet;

whereby when said retractable button is driven to slide in said fixing sleeve, a projective part of said retractable button can move out from a hole of said fixing sleeve to be locked and positioned in a hole of said lower joint tube, and when said upper joint tube is turned, a locking state can be released so that said fixing sleeve can move in said lower joint tube.

* * * * *